US007934623B2

(12) United States Patent
Cerruti

(10) Patent No.: US 7,934,623 B2
(45) Date of Patent: May 3, 2011

(54) WASHING AGENT DISPENSER FOR A HOUSEHOLD WASHING MACHINE, IN PARTICULAR A DISHWASHER

(75) Inventor: Daniele Cerruti, Fontanetto Po (IT)

(73) Assignee: Eltek S.p.A., Casale Monferrato (Alessandria) (IT)

( * ) Notice: Subject to any disclaimer, the term of this patent is extended or adjusted under 35 U.S.C. 154(b) by 725 days.

(21) Appl. No.: 11/997,866

(22) PCT Filed: Aug. 3, 2006

(86) PCT No.: PCT/IB2006/002258

§ 371 (c)(1),
(2), (4) Date: Feb. 4, 2008

(87) PCT Pub. No.: WO2007/017755

PCT Pub. Date: Feb. 15, 2007

(65) Prior Publication Data

US 2009/0145922 A1 Jun. 11, 2009

(30) Foreign Application Priority Data

Aug. 5, 2005 (IT) ..... TO2005A0554

(51) Int. Cl.
*B67D 7/74* (2010.01)

(52) U.S. Cl. ..... 222/129; 222/1; 134/93

(58) Field of Classification Search ..... 222/1, 129, 222/651, 169, 499–552, 481, 652; 134/93, 134/94.1, 95.1, 56 D, 57 D, 57 DL, 58 D, 134/58 DL; 68/17 A, 210
See application file for complete search history.

(56) References Cited

U.S. PATENT DOCUMENTS

| | | | | |
|---|---|---|---|---|
| 3,419,190 | A * | 12/1968 | Kauffman et al. | 222/652 |
| 3,822,571 | A * | 7/1974 | Waugh | 68/17 R |
| 3,828,975 | A * | 8/1974 | Robandt et al. | 222/651 |
| 5,261,432 | A * | 11/1993 | Sandrin | 134/93 |
| 7,337,635 | B2 * | 3/2008 | Cerruti et al. | 68/17 R |
| 7,578,150 | B2 * | 8/2009 | Zsambeki | 68/17 R |
| 7,721,917 | B2 * | 5/2010 | Marone | 222/129 |
| 7,823,236 | B2 * | 11/2010 | Cerruti | 8/147 |

FOREIGN PATENT DOCUMENTS

| | | |
|---|---|---|
| EP | 0 719 517 A2 | 7/1996 |
| EP | 0 719 517 A3 | 5/1997 |
| EP | 0 602 572 B2 | 7/2002 |
| FR | 2 593 379 A1 | 7/1987 |

OTHER PUBLICATIONS

International Search Report for corresponding International Application No, PCT/IB2006/002258, dated Dec. 13, 2006.
Written Opinion of the International Searching Authority for corresponding International Application No. PCT/IB2006/002258 dated Dec. 20, 2006.

* cited by examiner

*Primary Examiner* — Lien T Ngo
(74) *Attorney, Agent, or Firm* — Heslin Rothenberg Farley & Mesiti P.C.; Victor A. Cardona, Esq.

(57) ABSTRACT

A washing agent dispenser has two washing agent distributors controlled by a same actuation system that comprises a driving member, a driven member and an actuator device. The driven member has a seat in which there is operatively inserted, with possibility of relative movement, an engagement part of the driving member. According to the invention, also the driving member has a seat which, in at least one position of the actuation system, at least partially faces the seat of the driven member. The actuation system further comprises a floating body, able to displace in a controlled way between the two seats when said seats at least partially face one another.

21 Claims, 11 Drawing Sheets

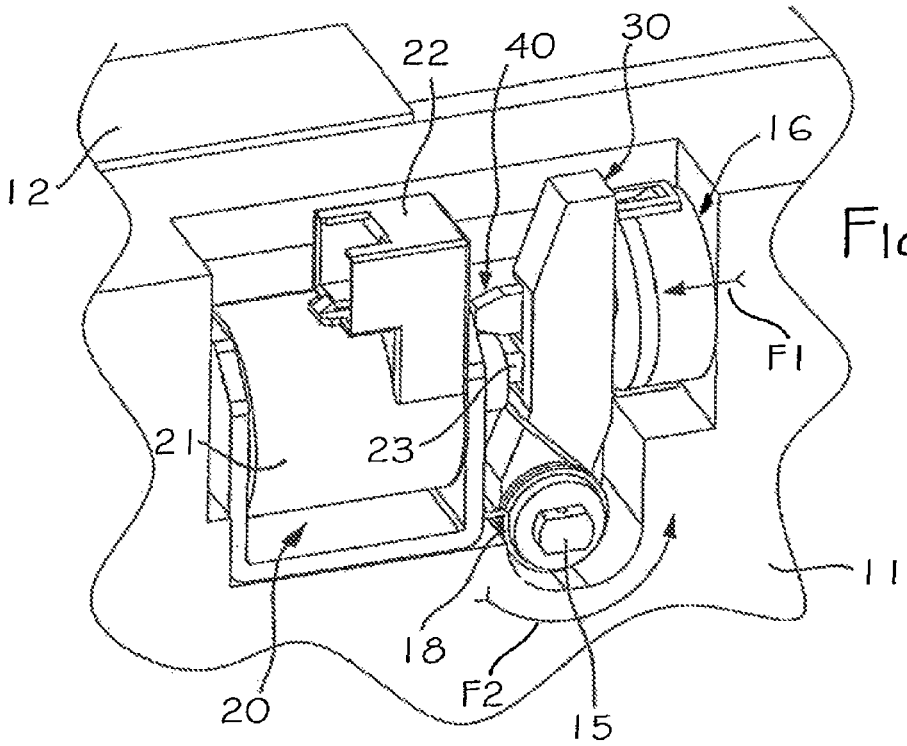
Fig.5
Fig. 6
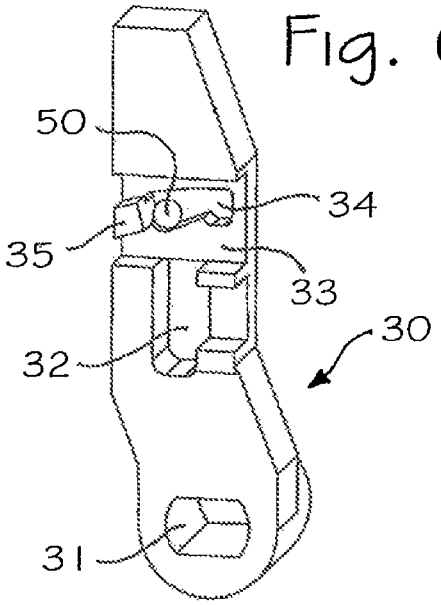
Fig. 7
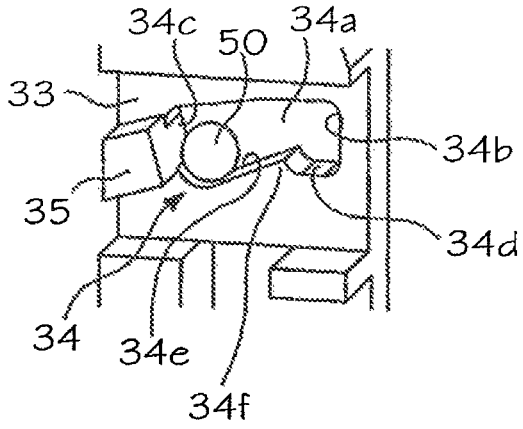

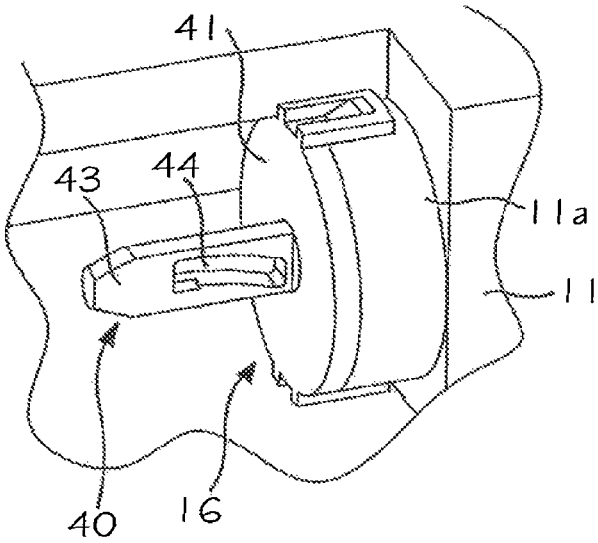
Fig. 8
Fig. 9
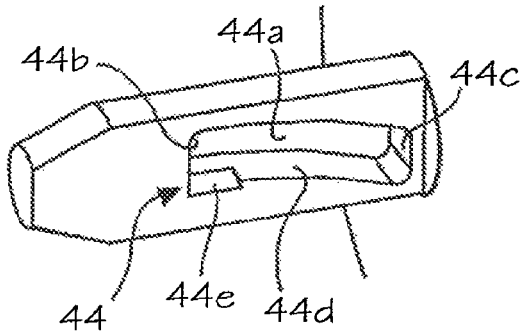
Fig. 10
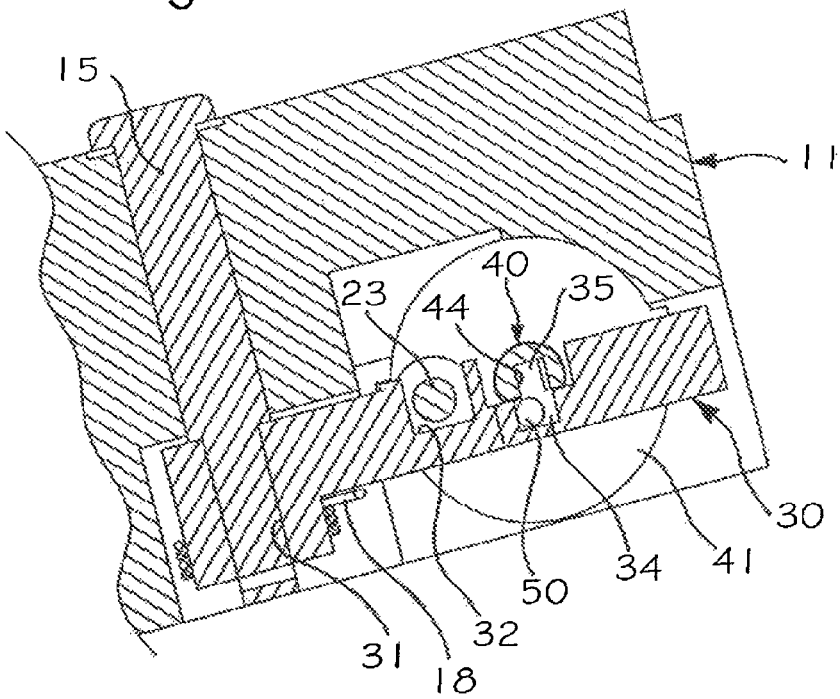

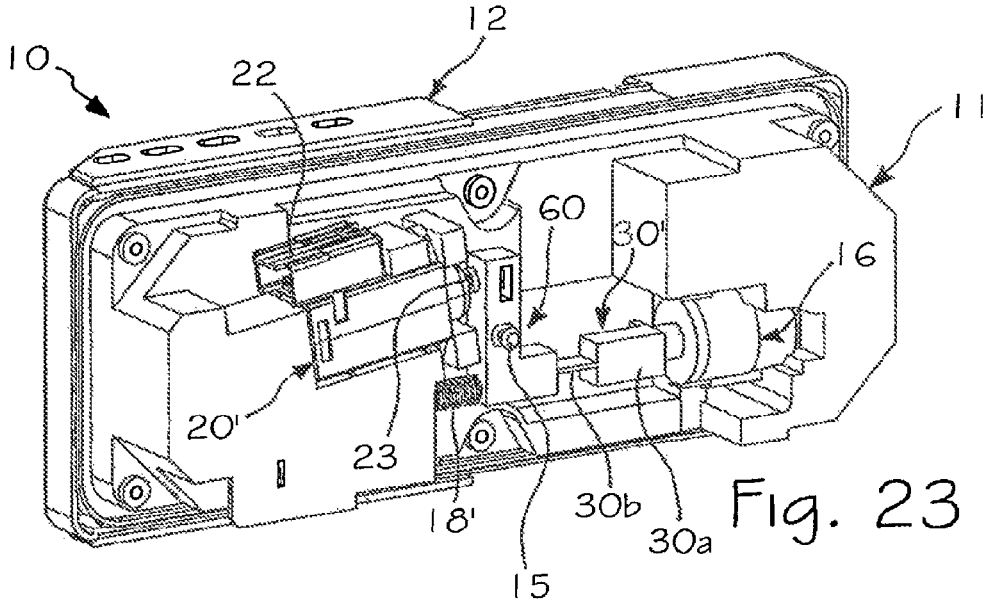
Fig. 23
Fig. 24
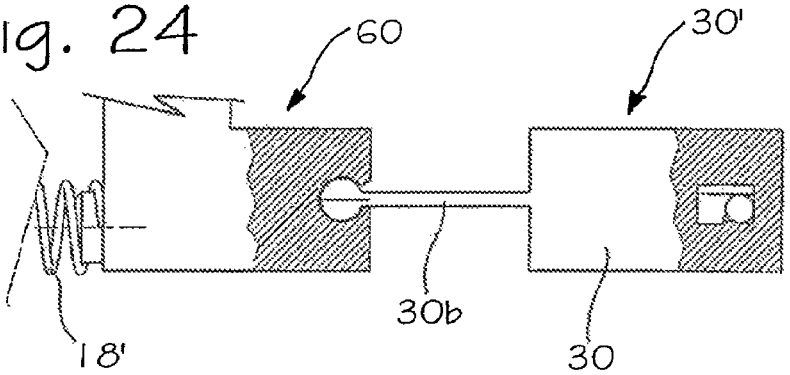
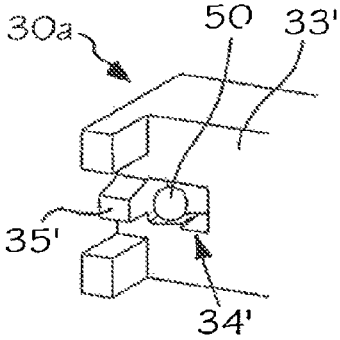
Fig. 25
Fig. 26
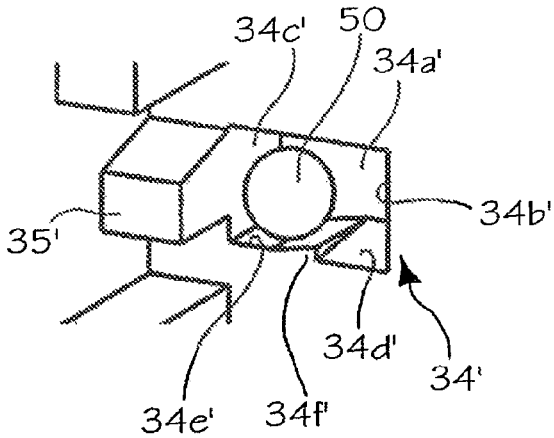

Fig. 27
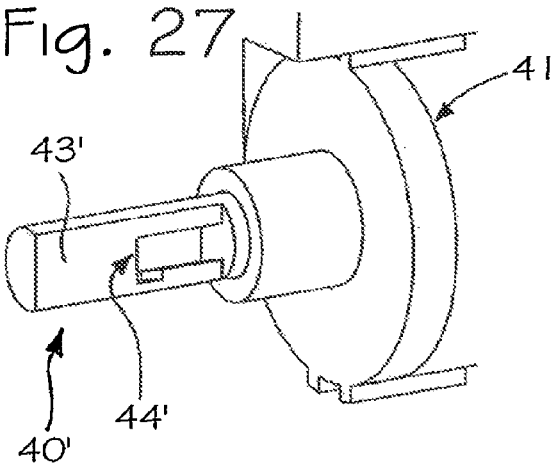
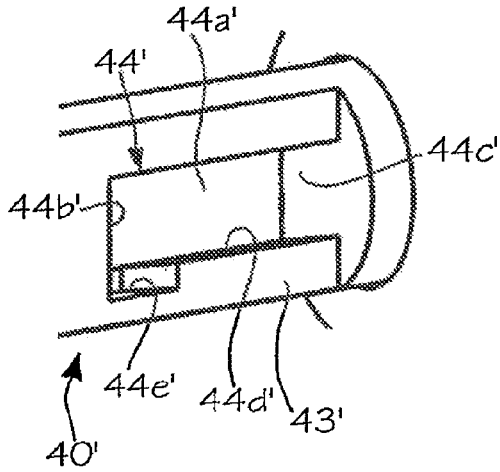
Fig. 28
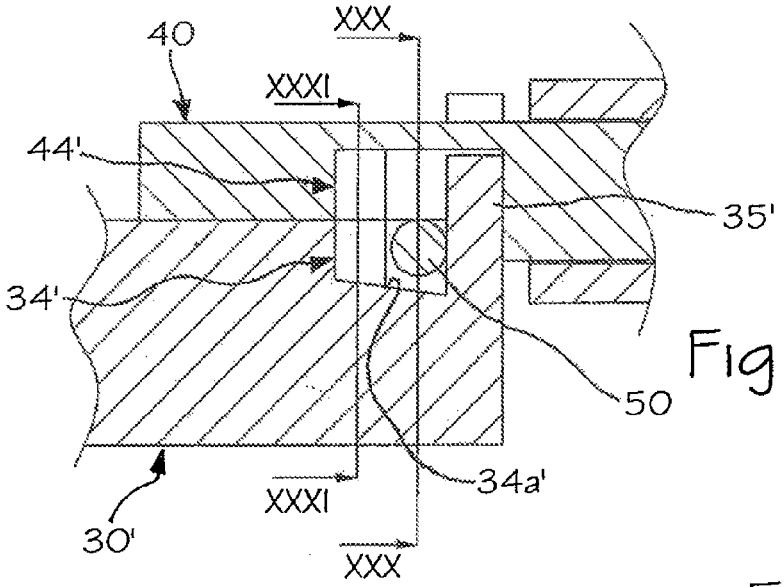
Fig. 29
Fig. 30
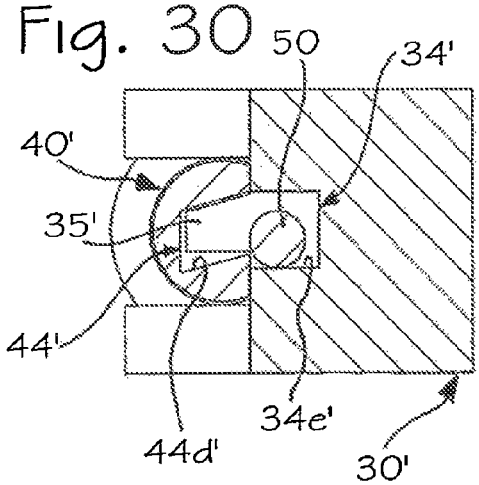
Fig. 31
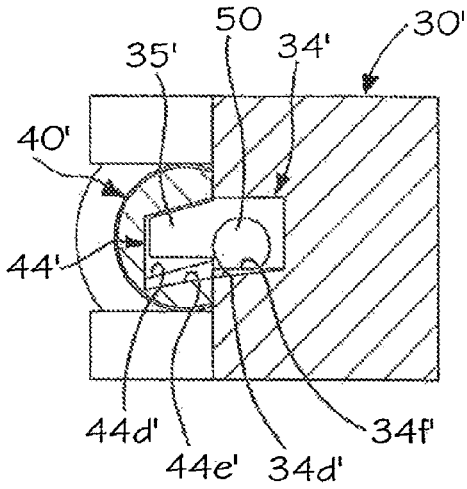

WASHING AGENT DISPENSER FOR A HOUSEHOLD WASHING MACHINE, IN PARTICULAR A DISHWASHER

CROSS REFERENCE TO RELATED APPLICATIONS

This application is a national stage of PCT International Application No. PCT/IB2006/002258, filed on Aug. 3, 2006, and published in English on Feb. 15, 2007, as WO 2007/017755 A1, which claims priority from Italian patent application No. TO 2005A000554, filed on Aug. 5, 2005, the entire disclosures of which are incorporated herein by reference.

FIELD OF THE INVENTION

The present invention relates to a washing agent dispenser for a household washing machine, in particular a dishwasher, comprising a first and a second distributor for washing agents that have to be delivered at distinct times or washing phases.

STATE OF THE PRIOR ART

In washing machines, ad in particular in household dishwasher, the use is known of dispenser devices, designed to deliver different washing agents, typically a solid detergent (powder or tablet) and a liquid additive, such as a rinse aid; said dispenser are conceived for carrying out delivering of the detergent and the additive at different predetermined times, under the control of the programmer, or timer, of the dishwasher.

In the case of dishwashers the dispenser device generally comprises a main body associated to the front-loading door of the machine, in which body a single-dose compartment is defined, provided with a lid—mounted for oscillating or sliding—that is made to open at the appropriate moment of the washing step. Moreover, in the body a tank is also defined, for the liquid additive, associated to which are valve or interception means, for controlling the corresponding delivery. In some cases, a dosing cup for the liquid additive is also associated to said tank and valve means; the devices of this kind usually exploit the opening movement of the front door of the machine, that is horizontal when open and vertical when closed, to load a single dose of the liquid additive from the storage tank to the dosing cup, for the purpose of the subsequent delivery. Other dispensers, being of more recent conception, are designed for supplying a number of distinct doses of liquid additive at different times during the same washing cycle, without requiring the above dosing cup.

Irrespective of the specific embodiment of the liquid additive dosing/delivering system, devices are known that comprise a single actuator, arranged for operating in all the delivery cycles of the detergent and the additive. A solution of this type is disclosed, for instance, by EP-A-0 602 572.

The known systems with just one actuator are generally distinguished by rather complicated and cumbersome mechanisms, which comprise a plurality of components that are particularly subject to wear over time. Additionally, in the known of the referred type, delivery of a number of doses of rinse aid—even if possible—requires a great number of operation of the actuation system (for instance the solution described in EP-A-0 602 572 would require, to deliver each dose of rinse aid following the first delivering, at least two actuation of the system); resetting of the actuation system to the start position is obtained every two actuations of the actuator, or by means of an action on the hook of the dispenser lid.

SUMMARY OF THE INVENTION

The present invention has mainly the aim to provide a dispenser of the type referred to above, having an actuation system of new conception, that is extremely simple from the constructional and functional standpoint, and is provided with a coupling mechanism very compact and not very subject to wear. An additional aim of the invention is to provide such an actuation system that is particularly suitable for the use in dispenser designed to deliver a plurality of doses of a washing agents in the frame of a same operating cycle of the relevant washing machine.

One or more of these aims are achieved, according to the present invention, by a dispenser device and by a method for delivering washing agents for a household washing machine, in particular a dishwasher, having the characteristics of the annexed claims, which form an integral part of the descriptive contents of the present patent application.

BRIEF DESCRIPTION OF THE DRAWINGS

Further aims, characteristics and advantages of the present invention will emerge clearly from the ensuing detailed description and from the annexed plate of drawings, which is provided purely by way of explanatory and non-limiting example and in which:

FIG. 5 is an enlarged detail of FIG. 4, relating to an actuation system of the dispenser according to the invention;

FIG. 6 is a perspective view of a driving member and a floating body forming part of the system of FIG. 5;

FIG. 7 is an enlarged detail of FIG. 6;

FIG. 8 is a perspective view of a driven member forming part of the system of FIG. 5;

FIG. 9 is an enlarged detail of FIG. 8;

FIG. 10 is a schematic cross section of the dispenser according to the invention, in a door open condition, as in FIG. 1;

FIG. 23 is a perspective view of the rear part of the dispenser according to the invention, in a second embodiment;

FIG. 24 is a schematic view in partial cross section of a system for articulation between two components of the dispenser of FIG. 23;

FIG. 25 is a perspective view of a portion of a driving member and of a floating body forming part of the actuation system of the dispenser of FIG. 23;

FIG. 26 is an enlarged detail of FIG. 25;

FIG. 27 is a perspective view of a driven member forming part of the actuation system of the dispenser of FIG. 23;

FIG. 28 is an enlarged detail of FIG. 27;

FIG. 29 is a schematic longitudinal section of a coupling zone between the members of FIGS. 25 and 27;

FIGS. 30 and 31 are two schematic cross sections, respectively according to the line XXX-XXX and the line XXXI-XXXI of FIG. 29;

DETAILED DESCRIPTION OF PREFERRED EMBODIMENTS OF THE INVENTION

Figure 1:
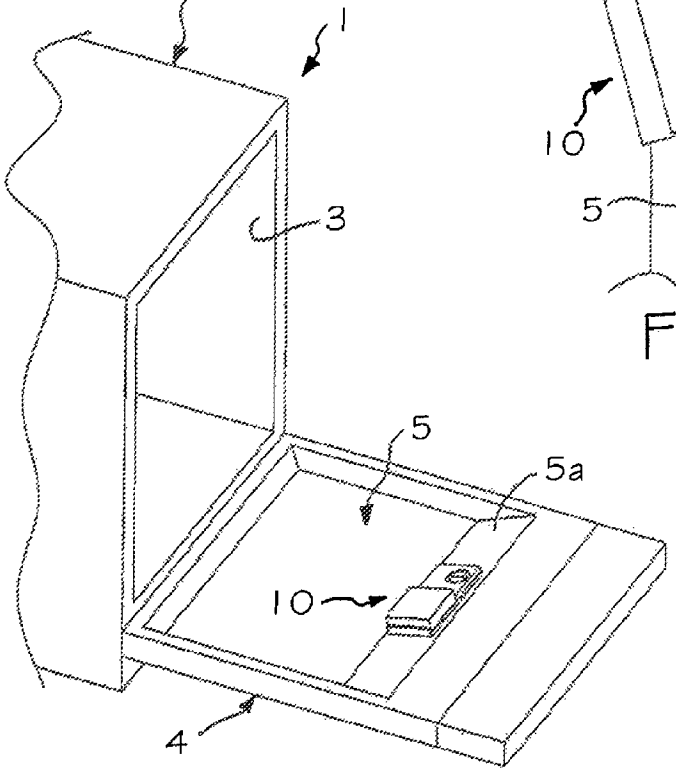
FIG. 1 is a partial perspective view of a dishwasher with the respective door in the open position, equipped with a washing agent dispenser according to the present invention.

In FIG. 1, reference 1 designates as a whole a dishwashing machine, comprising a cabinet 2 within which a washing chamber 3 is defined. A door 4 is associated to the cabinet 2, which door—in the example—can swing, i.e., is hinged in the lower region thereof to be able to rotate about a substantially horizontal axis. The surface of the door 4 designed to frontally delimit the chamber 3—i.e., the so-called "inner-door"—has a shaped or drawn portion 5, comprising an inclined wall 5*a*. As is visible also in FIG. 2, an aperture is defined in said inclined wall 5*a*, wherein a washing agent dispenser is partially housed, in a sealed way, designated by 10.

The dispenser 10 comprises two distributors of different washing agents, and in particular a distributor for a solid detergent, in powder or tablet form, and a distributor for a liquid additive, or rinse aid; hereinafter, for the sake of simplicity, the first and the second distributor will be defined as "detergent distributor" and "rinse aid distributor", respectively.

Figure 3:
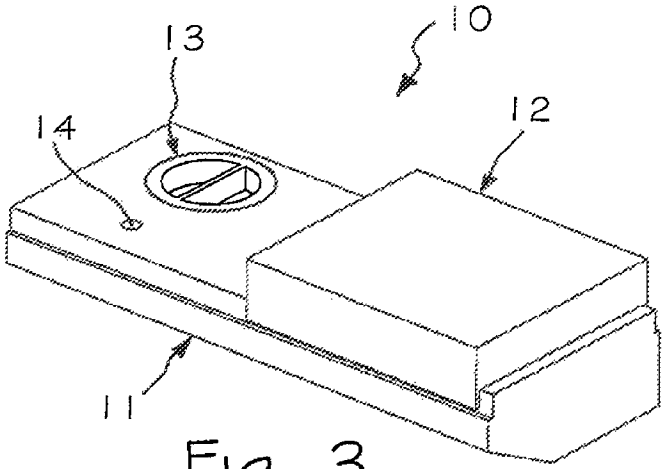
FIGS. 3 and 4 are schematic perspective views of a dispenser according to the invention, according to two different angulations.

As is visible in FIG. 3, the dispenser has a main body 11, for instance including at least two pieces made of thermoplastic material welded to each other. In the front piece of the body 11 a compartment for containing the detergent is formed (not visible), functionally associated to which is a respective lid 12; in the case exemplified, the lid 12 is slidably mounted on the body 11 and is able to move between an opening position and a closing position, only the latter being represented in the figures; it may be noted that the lid could be of a different type, for instance a swinging lid, i.e., hinged to the body 11, according to a known technique. Formed within the body 11 is a tank for the liquid rinse aid, not visible, in communication both with a load opening provided with a removable plug, designated by 13, and with a delivery opening 14.

The dispenser 10 is equipped with a hooking/releasing device, provided for blocking the lid 12 in the closing position and then unblocking it, in order to enable it to be opened under the action of elastic means, when the detergent is to be delivered; the dispenser 10 is moreover provided with a valve device, for control of delivery of the rinse aid. The aforesaid devices are of a conception known in the art and consequently they are not described herein; it suffices to note that, in the exemplified embodiment:

the above hooking/releasing device comprises a small shaft (hereinafter designated by 15—see for example FIGS. 5 and 10) that passes through body 11 and bears, at a first end thereof, a hooking member adapted to co-operate with a respective hooking member of the lid 12; the second end of the shaft is operatively connected with an actuation system (hereinafter designated as a whole by 17), that is present in the rear part of the body 11 and is capable to cause rotation of the same shaft about the axis thereof, under the control of the programming device of the machine 1;

the above valve device (a portion of which is designated as a whole by 16 in FIG. 5) can be selectively actuated to cause discharge by opening 14 of at least one dose of rinse aid; also the cited valve device is actuated through the above mentioned actuation system, under the control of the programmer of the machine 1; possibly, the valve device can be associated with a known dosing cup or similar dosing system provided within g the body 11, communicating with the tank of the rinse aid and with the opening 14.

Figure 2:
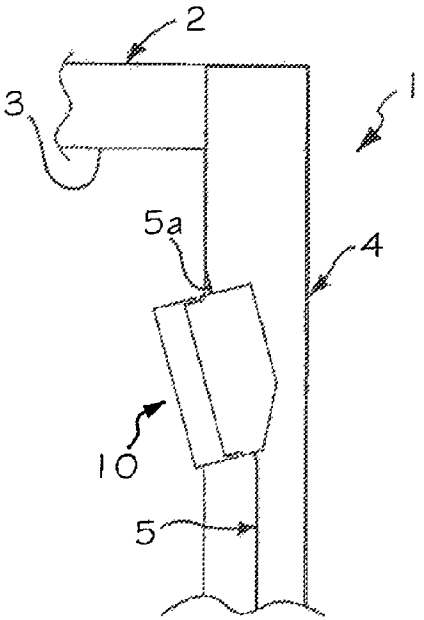
FIG. 2 is a schematic section of a portion of the washing machine of FIG. 1, with the door closed.

In FIG. 1 the door 4 is represented in the opening position; in said condition, the compartments designed to contain the detergent and the load opening of the tank of the rinse aid are accessible from above, for the usual operation of loading of the washing agents; in FIG. 2 there is instead represented the condition of door 4 being closed, wherein—following upon opening of the lid 12, the detergent can freely fall by gravity within the chamber 3; in the same way, following upon actuation of the above mentioned valve device of the rinse aid distributor, the liquid washing agent can leave body 11, by means of the opening 14 and flow within the chamber 3.

Figure 4:
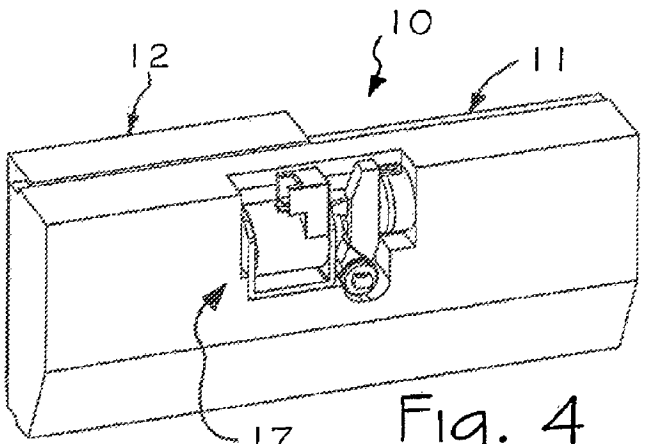

As mentioned, the shaft being part of the hooking/releasing system of the detergent distributor and he valve device being part of the rinse aid distributor are operated through a same actuation system, designated by 17 as a whole in FIG. 4, that constitutes the specific subject of the present invention. The actuation system is represented in greater scale in FIG. 5; as is visible in this figure, the system 17 comprises a single actuator, designated as a whole by 20; in the exemplified case, the actuator is a solenoid actuator, well known in the field and hence such as not to require any detailed description; here it is sufficient to point out that:

the actuator 20 comprises an induction winding or coil 21, associated to which is a connector 22 for electrical supply, and a movable core 23; and following upon supply of the coil 21, the core 23 is induced to move in the direction indicated by the arrow F1, countering the action of at least one elastic means.

The movable core 23 has a respective end that projects constantly from the coil 21 and is operatively constrained to a driving member; in the case exemplified, said member is constituted by an angularly movable lever, designated as a whole by 30; the lever 30 is keyed, in its lower part, to the above shaft—designated by 15—being part of the hooking/releasing device of the detergent distributor.

The lever 30 is operatively constrained, in an intermediate area thereof, to a driven member; in the case exemplified, said member is constituted by a rod or slider 40, which is able to slide linearly in a direction parallel to the movable core 23, or in the direction indicated by the arrow F1; said rod is part of the above valve device—designated by 16—of the rinse aid distributor.

As may be understood, the arrangement is such that, following upon supply of the coil 21, with the consequent recession of the movable core in the direction indicated by the arrow F1, the lever 30 is able to move angularly in the direction indicated by the arrow F2, countering the elastic reaction of a spring 18, interacting between the lever itself and the main body 11 of the dispenser.

As may be seen in FIG. 6, the lever 30 has, in the lower area thereof, a shaped passage 31 for keying with the shaft 15; in an intermediate area, above the passage 31, an engagement slot or seat 32 is formed, designed to receive a shaped end of the movable core 23 (see, for example, FIG. 10). On top of the slot 32, the lever 30 then has a rectilinear region of reduced thickness, set transverse with respect to the axis of the lever 30, having a plane wall or surface 33; defined in said region is a shaped slot, which provides a seat designated as a whole by 34, open in correspondence of the aforesaid plane surface 33; moreover, projecting from the plane surface 33 is an engagement part, here configured a projection or relief 35.

As may be seen in FIG. 7, the seat 34 has a bottom surface 34*a* and a peripheral profile in which there may be identified an upper surface (not indicated), two longitudinal end surfaces 34*b*, 34*c* and a lower surface, the latter being shaped so as to define a substantially plane portion, designated by 34*d*, and a portion shaped like an inclined plane, designated by 34*e*, a cusp 34*f* being formed between said portions. From FIG. 6 it may moreover be noted that, in the case exemplified, the relief 35 has a lateral surface substantially in common with the longitudinal end surface 34*c* of the seat 34.

As may be seen in FIG. 8, the rod 40 comes out of an opening formed in a cover 41, that is fastened in a sealed way to a portion 11*a* of the body 11 of the dispenser; in the region of the rod 40 that protrudes of the cover 41 a substantially plane surface 43 is defined, and formed in said region is a shaped slot, which provides a seat designated as a whole by 44, open in correspondence to the aforesaid plane surface 43; the seat 44 has a slightly arched longitudinal development and dimensions such as to be able to receive, with possibility of movement, the projection 35 of the lever 30, as will emerge hereinafter.

As may be seen in FIG. 9, the seat 44 has a bottom surface 44*a* and a peripheral profile in which it is possible to identify an upper surface (not indicated), two longitudinal end surfaces 44*b*, 44*c*, and a lower surface; the latter has a profile shaped so as to define a prevalent portion, designated by 44*d*, and a slide portion 44*e*, close to the longitudinal end surface 44*b*; as may be noted, the surface portion 44*e* is inclined in a direction transverse with respect to the development of the surface portion 44*d*, providing, that is, a sort of slide, which is lateral with respect to the latter. The seat 44, or at least said prevalent surface portion 44*d* is inclined with respect to the axis of the rod 40.

The lever 30 and the rod 40 can be conveniently made of thermoplastic material, via moulding operations.

Finally, in FIGS. 6 and 7, the reference number 50 designates a floating body, of dimensions such as to be containable both in the seat 34 and in the seat 44, with possibility of displacing selectively between the seats themselves, which are provided for the purpose, as will appear hereinafter; by the term "floating" is meant herein that the body 50 is preferably without constraints, or not joined to other parts, it remaining understood that said body 50, as has been said, is housed alternatively in the seats 34 and 44. In the embodiment exemplified, and at the moment deemed preferential, the aforesaid body is constituted by a ball, for example, a steel ball.

Once the lever 30 and the rod 40 are assembled in the dispenser, they are arranged in such a way that at least part of the respective plane surfaces 33 and 43, and hence at least part of the seats 34, 44, face one another, with the projection 35 of the lever 30 inserted within the seat 44 of the rod 40, and with part of the rod 40 inserted in the region with reduced thickness of the lever 30 in which the surface 33 is formed. Said condition is visible in the schematic cross section of FIG. 10. It should be noted that the surfaces 33 and 43 of the members 30 and 40 must not necessarily be plane, and could possibly be complementary to one another, and hence even of different shapes (for example, one surface with a convex profile which slides on a surface with a concave profile); in general terms, therefore, it is sufficient for the surfaces 33, 43 to be designed to co-operate with one another in sliding relationship.

To return to FIG. 10, the actuation system is represented therein in an initial inoperative condition, with a dose of detergent already loaded in the respective compartment closed by the lid 12, but with the door 4 of the dishwasher 1 still open or substantially horizontal (see FIG. 1). The same condition of the actuation system, but with the door 4 closed, and hence substantially vertical, is represented also in FIG. 11 and in the corresponding schematic cross section of FIG. 12, limitedly to the parts of interest, as well as in FIG. 13, where the lever 30 is partially sectioned in a position corresponding to the seat 34 (in practice, with a plane of partial cross section passing in the proximity of the bottom surface 34*a* of the seat 34). As may be appreciated, particularly from FIGS. 12 and 13, in the initial condition the seats 34 and 44 face one another and are set alongside one another, and the ball 50 is within the seat 34 of the lever 30, and in particular in the lowest stretch of the portion of lower surface 34*e*, in contact also with the longitudinal end surface 34*c*. Notwithstanding the inclination of the dispenser 10, and hence of the actuation system 17, the ball 50 is prevented from moving into the seat 44 since, in the condition under examination, the portion of lower surface 44*d* of the seat 44 is found at a greater height than the portion of lower surface 34*e* of the seat 34; it should moreover be noted that, in this position, the bottom end of the slide portion 44*e* of the seat 44 is substantially at the same height as the portion of lower surface 34*d* of the seat 34.

Figure 14:
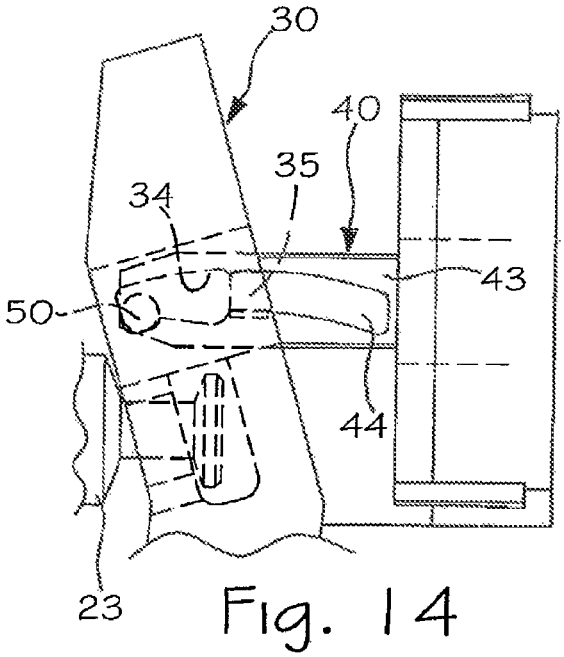
FIGS. 14-16 are views similar to the ones of FIGS. 11-13, but with the actuation system of the dispenser according to the invention in a second condition.
Figure 15:
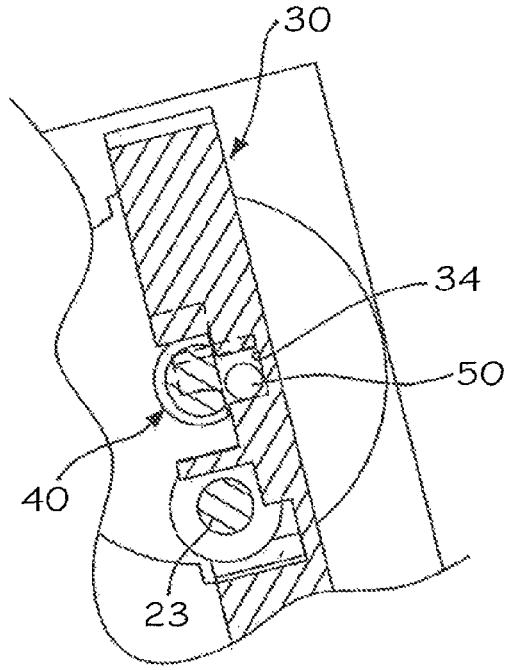
Figure 16:
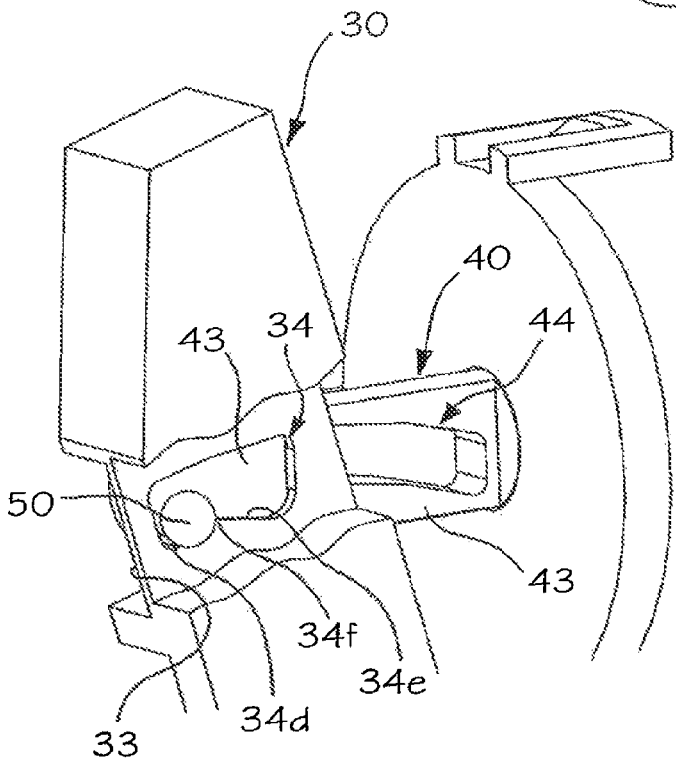

At a certain time of the washing cycle, when the solid detergent has to be delivered, the programming device of the machine 1 controls supply of the coil 21, thus determining recession of the core 23; it should be noted that the supply of the coil determines a fast and sudden movement of the core 23, with a consequent sharp angular movement of the lever 30 as far as the position visible in FIGS. 14-16; the movement of the lever 30 produces rotation of the shaft 15, with consequent release of the lid 12 of the dispenser 10, such that the detergent is free to fall by gravity in the washing chamber 3 of the machine. In actual fact, the movement of the lever is not transmitted top the rod, since the relief 35 is free to slide within the seat 44, performing a maximum stroke therein, until it comes into contact with the end surface 44*b* shown in FIG. 9. As an alternative, the system can also be conceived in such a way that, following upon the movement of the lever 30, interaction between the relief 35 and the end surface 44*b* of seat 44 causes a sliding of the rod 40 that is not significant, i.e., of reduced length, or in any case not sufficient to enable delivery of the liquid additive. As may be readily understood for example from FIG. 14 or 16, at the end of the angular movement, the seat 34 of lever 30 faces a full region of the surface 43 of the rod 40.

Figure 17:
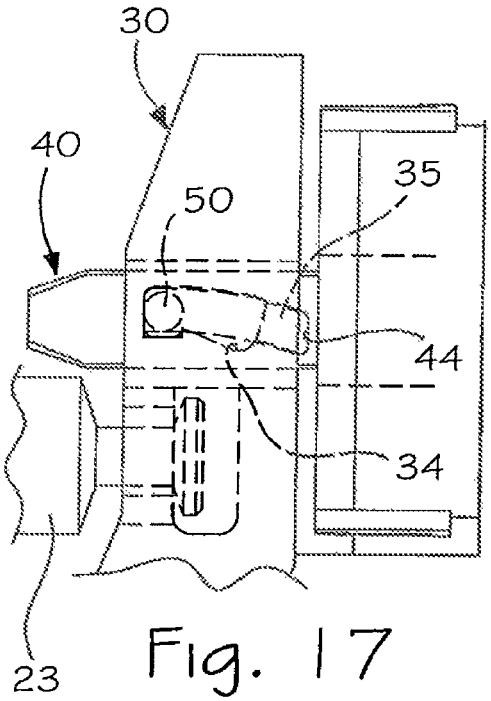
FIGS. 17-19 are views similar to the ones of FIGS. 11-13, but with the actuation system of the dispenser according to the invention in a third condition.
Figure 18:
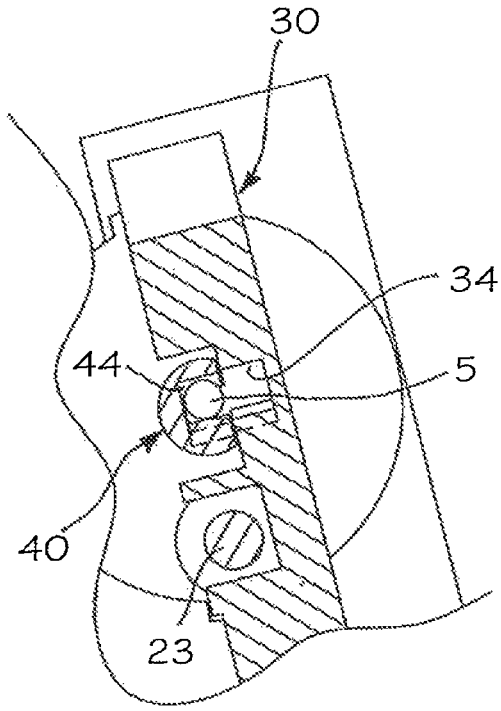
Figure 19:
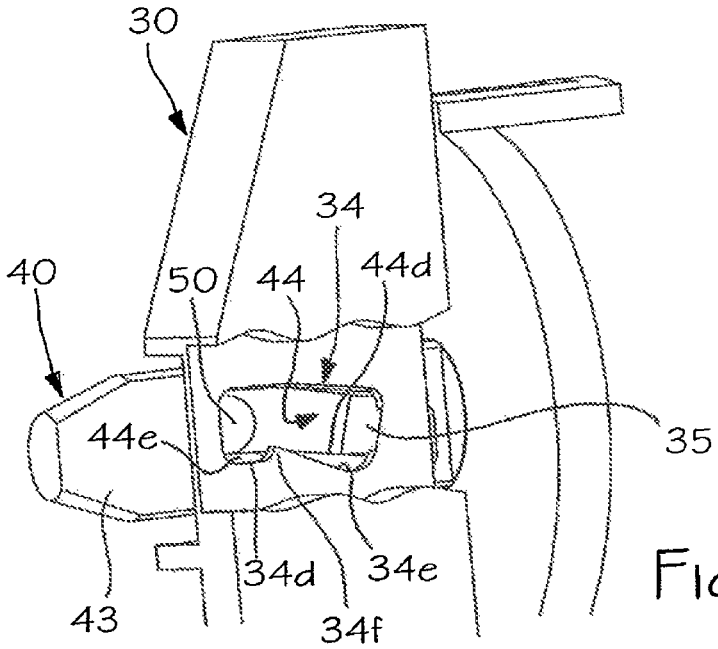

The above sharp movement of the lever 30 is such that the ball 50 is induced to climb up the inclined plane defined by the portion of lower surface 34*e* of the seat 34, until it passes beyond the cusp 34*f* and then passes to the portion of lower surface 34*d*, as is clearly visible in FIG. 16; given the inclination of the dispenser 10, the ball 50 rests laterally with respect to the surface 43 of the rod 40 and is maintained in the position that it has reached thanks to the presence of the cusp 34*f*. Once the supply pulse to the coil 21 is interrupted, the core 23 and the lever 30 return to their respective initial positions, thanks to the action of the spring 18, as represented in FIGS. 17-19. In this way, the surface 33 of the lever 30 slides with respect to the surface 43 of the rod 40, which is motionless, until the seats 34 and 44 once again face one another, as may be seen, for example, in FIG. 19, with the portion of lower surface 34*d* of the seat 34 that is once again in a position corresponding to the slide portion 44*e* of the lower surface of the seat 44; as has been said, in this position the lower end of the slide portion 44*e* is substantially at the same height as the portion of lower surface 34*d*. In this way, given the inclined arrangement of the dispenser, the ball 50 is free to roll from the portion 34*d* of the seat 34 onto the slide portion 44*e* of the seat 44, as may be seen in FIG. 19, and then roll on the portion of lower surface 44*d* (see FIG. 9) of the seat 44, until it reaches a position in which it rests against the lateral surface of the relief 35, inserted in said seat. In effect, then, the ball 50 passes from the seat 34 to the seat 44; the ball remains in said position thanks to the inclination of the dispenser 10 and to the slightly arched shape of the seat 44.

Figure 20:
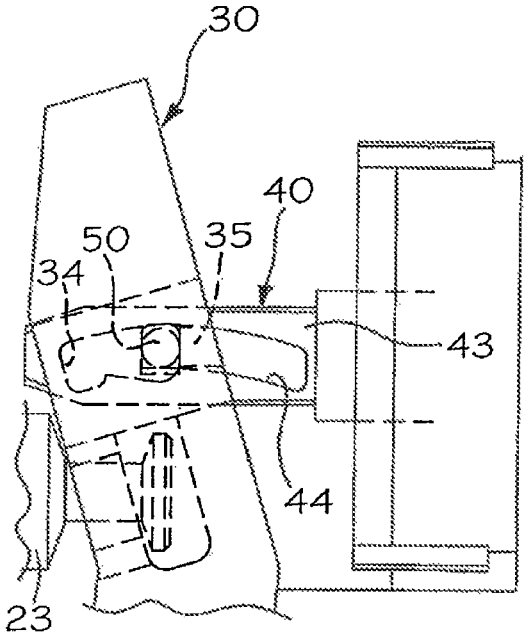
FIGS. 20-22 are views similar to the ones of FIGS. 11-13, but with the actuation system of the dispenser according to the invention in a fourth condition.
Figure 21:
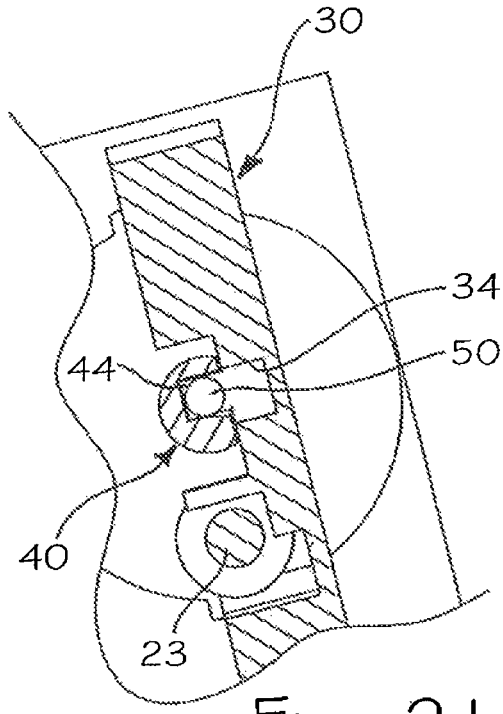
Figure 22:
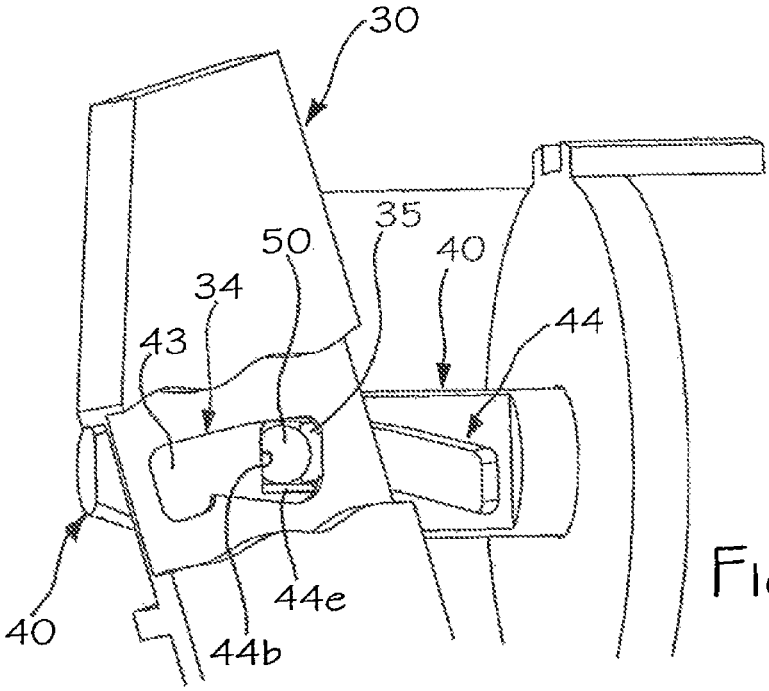

At a subsequent moment of the washing cycle, when it becomes necessary delivery of a dose of rinse aid, the programming device of the machine 1 brings about a new supply of the coil 21, thus bringing about a new recession of the core 23 and hence a new angular movement of the lever 30, as may be seen in FIGS. 20-22. In the course of the movement of the lever 30, the respective relief 35 is free to slide within the seat 44 of the rod 40; however, unlike what occurs in the course of the first actuation (FIGS. 14-16), in this condition the ball 50 is housed within the seat 44, thus reducing the stroke allowed for the relief 35 within the seat 44. In the course of its stroke, the relief 35 will displace the ball 50 along the seat 44; at a certain point, as illustrated in FIG. 22, the ball 50 will then come to rest, on one side, against the end surface 44*b* of the seat 44, and, on the opposite side, a thrust will be exerted on said ball 50 by the relief 35 of the moving lever 30. It is evident how, unlike the previous actuation, a greater part of the angular movement of the lever 30 will in this case be transferred to the rod 40, with a consequent linear translation of the latter. As may be readily understood, the amount of said translation is a function of the overall dimensions of the ball 50. The movement thus obtained of the rod 40 determines the actuation of the valve device 16 of the rinse aid distributor, with the subsequent delivery, through opening 14 of FIG. 3, of a dose of the liquid washing agent towards the washing chamber of the machine. Also in this case, when supply of the coil 21 ceases, the core 23, the lever 30 and the rod 40 will return to their respective resting positions by virtue of the action of the spring 18, as may be seen, for example, in FIG. 19; it should be noted that, in actual fact, as compared to FIG. 19, the ball 50 will roll once again along the seat 44, until it comes to rest against the relief 35.

Of course, should the selected washing cycle provide one or more further deliveries of rinse aid, the coil 21 will again be supplied, thus producing an operation of the actuation system 17 that is similar to what has been described with reference to FIGS. 20-22.

Figure 11:
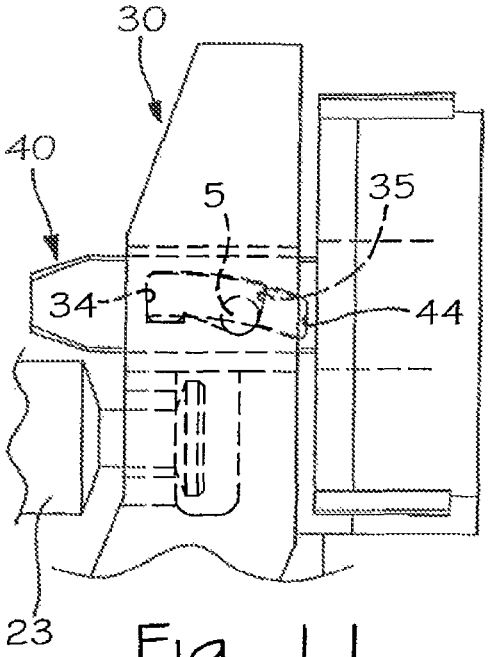
FIGS. 11-13 are, respectively, a side view, a cross-sectional view and a partially sectioned perspective view, these being schematic views, of the actuation system of the dispenser according to the invention, in a first condition.
Figure 12:
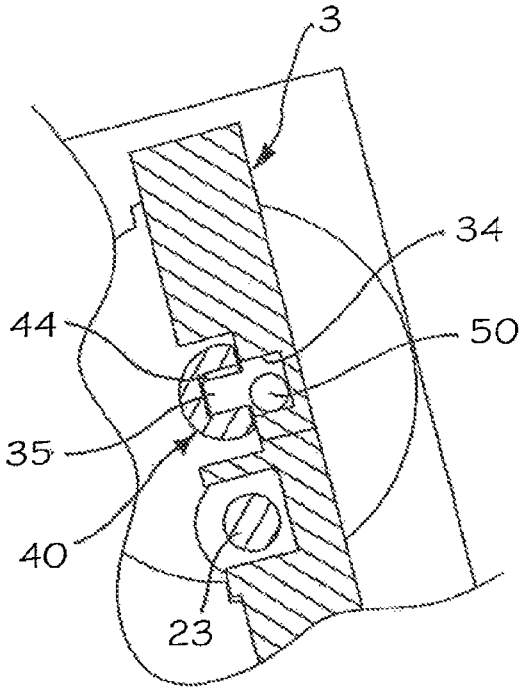
Figure 13:
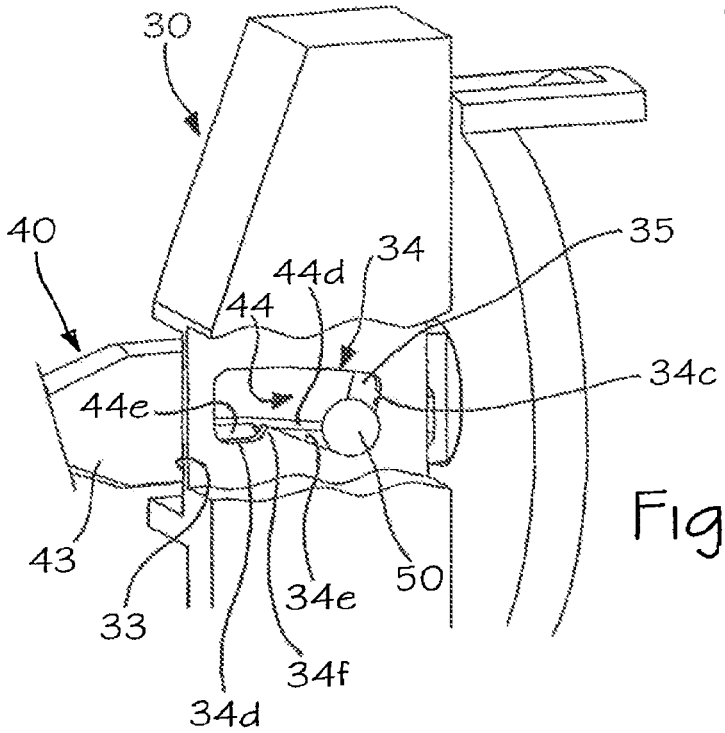

Restoring or resetting of the actuation system the initial condition of FIGS. 11-13 is obtained after the end of washing cycle, when the user of the machine 1 opens the door 4, bringing it for instance in the position represented in FIG. 1 or 10; as may be readily understood, in particular from FIG. 10, when the door 4 is turned over, the seats will come to assume a position where they are set on top of one another, in particular with the seat 44 of the rod 40 above the seat 34 of the lever 30, and with the ball 50 that may thus freely pass or fall by gravity from the first seat to the second seat. During the subsequent closing of the door 4, the ball 50 will be prevented from passing into the seat 44 since, as has been said, in the inoperative condition of the actuation system 17, the portion of lower surface 44*d* (see FIG. 13) of the seat 44 is found at a greater height than the portion of lower surface 34*e* of the seat 34.

It should be considered that, in the daily practice, it may happen that a user of the machine stops temporarily a washing cycle under progress, by opening the door 4, for instance in order to add some dishes in the machine; as it can be appreciated, this circumstance might negatively affect the correct operation of the described actuation system, which will be prematurely restored to the start condition. In particular, if said opening of the door 4 occurs before delivery of the powder detergent, there will not be any particular problems. By contrast in the case—that is rare but possible in theory—in which the opening of the door occurs after delivery of the powder detergent, the subsequent actuation cycle of the system 17, aimed at causing delivery of the rinse aid, will result ineffective (in practice, the actuation would cause only the passage of the ball from the seat 34 to the seat 44—FIG. 15-20—without entailing any movement of the rod 40).

To this purpose it should be remembered that the existing washing machines are equipped with electronic control systems, that can be easily arranged to detect a door opening, for instance by associating a micro-switch to the latch of the door or to a hinge thereof. Within this frame, the control system of the machine 1 is thus arranged to detect a possible opening of the door 4 during a washing cycle; in case this opening occurs at a time following delivery of the powder detergent, but before delivery of the rinse aid, the control system of the machine will control an additional actuation of the actuator 20, aimed at bringing—in any case—the actuation system 17 in a correct condition for the purposes of effective delivery of the rinse aid at the proper time.

As mentioned above, the actuation system can be conceived such that, also following upon the first actuation of the actuator 20, a reduced part of the movement of the lever 30 is transferred to the rod 40, i.e., with the driven member that can perform a given stroke, having a limited length compared to the one that can be obtained following upon a subsequent actuation of the actuator 20, and in any case not sufficient to cause delivery of the rinse aid. Such an implementation clearly simplifies manufacturing of the device, in terms of production and assembly tolerances.

The embodiment of the invention exemplified previously presupposes, for its operation, a certain degree of inclination of the dispenser 10; the illustrated example has been given in relation to a solution that is used in the field of dishwasher, wherein the dispenser is fastened to a portion of an inclined wall of the inner-door of the dishwasher. It is, however, clear that the actuation system 17 as a whole and/or the members 30, 40 and/or the seats 34, 44 could be configured for enabling the fastening of the dispenser 10 according to other possible planes of lie, and particularly a plane of lie in which the dispenser is in a substantially horizontal position when the door of the dishwasher is open, and is in a substantially vertical position when the door of the dishwasher is closed.

The simplest way, for example, is that of forming or mounting the actuation device 17 and/or the members 30 and 40 with respect to the body 11 with a slightly inclined configuration, in the direction desired for producing the effects described above. Another possible embodiment is, instead, exemplified in FIGS. 23-39, in which the same numbers as the ones used in the previous figures are partly re-used.

The actuation system 17' of the above said figures is provided with an actuator 20' of a type different from that of the previous embodiment, in particular an electro-thermal actuator, or thermo-actuator, well known in the field. Said actuator 20' comprises a respective plunger shaft or piston, designated by 23', designed to cause the angular movement of a lever 60 keyed to the shaft 15; in the example, the lever 60 is as a whole L-shaped, with a first end portion, upon which the piston 23' is designed to exert a pushing action, and a second end portion, articulated to which is a driving member, designated by 30', the functions of which, as regards the modalities of interaction with a respective driven member, are similar to the ones of the member 30 of the first embodiment. Operatively set between the lever 60 and the main body 11 of the dispenser is an elastic element, such as a spiral spring designated by 18'. It should be noted that the lever 60 and the driving member 30' could possibly be made of a single piece, for example, of moulded thermoplastic material, in such a way that the driving member 30' will comprise or will integrate also the lever 60.

The member 30' has a main body portion, designated by 30*a*, departing from which is a connection portion 30*b*, of a reduced cross section. The connection portion 30*b* is articulated, with a certain possibility of relative movement, to an end region of the lever 60; a possible system of articulation between the lever 60 and the member 30' is illustrated schematically in FIG. 24. In the case referred to above of a driving member 30' that comprises or integrates the lever 60, the connection portion 30*b* is preferably articulated in a flexible or elastic way, in particular by virtue of the characteristics proper to the aforesaid thermoplastic material. The aforesaid main body portion 30*a* is, instead, operatively coupled or constrained to a driven member, which, as in the previous embodiment, is constituted by a rod, designated by 40', being part of the valve device 16 of the rinse aid distributor.

The arrangement of the parts is such that, following upon supply of the thermo-actuator 20', the shaft 23' exerts a thrust on the upper area of the lever 60, with the latter that moves angularly in a clockwise direction (as viewed in FIG. 23), countering the elastic reaction of the spring 18', causing a pulling action on the driving member 30' and a variation of its overall slope with respect to the normal horizontal position.

As may be seen in FIG. 25, the portion 30*a* of the member 30' has a plane face or surface 33', in correspondence of which a shaped slot is defined, which provides an as a whole rectilinear seat, designated by 34', open in correspondence with the aforesaid plane surface 33'; from the surface 33' there moreover projects an engagement part, also in this case configured as projection or relief 35'. The seat 34' and the relief 35' basically have the same functions as the seat 34 and relief 35 of the first embodiment. As may be seen in FIG. 26, also the seat 34' has a bottom surface 34*a'*, an upper surface, not indicated, two longitudinal end surfaces 34*b'*, 34*c'* and a lower surface; as may be seen also in FIGS. 30 and 31, the lower surface of the seat 34' is shaped so as to define:

- a portion 34*d'* inclined transversely downwards or forwards, starting from the bottom surface 34*a'* of the seat 34' as far as the face 33' (the portion 34*d'* could possibly be inclined towards the bottom surface 34*a'*);
- a substantially plane portion, designated by 34*e'*; and
- an inclined wall defining a cusp 34*f'*, formed between the portions 34*d'* and 34*e'*.

In this embodiment, moreover, the seat 34' has a depth that increases starting from the end surface 34*b'* as far as the end surface 34*c'*; in other words, and as is clearly visible in FIG. 29, the bottom surface 34*a'* of the seat 34 is as a whole inclined.

The rod 40' is visible in FIG. 27, which also in this example protrudes out of a closing element or cover 41, with a region having a substantially plane surface 43' and formed in which is a shaped slot, which provides a seat 44', which is open in correspondence of the aforesaid plane surface 43' and basically has the same functions as the seat 44 of the first embodiment; the seat 44' has a rectilinear longitudinal development and dimensions such as to be able to receive, with possibility of movement, the relief 35' of the member 30', as is clearly visible in FIGS. 30 and 31.

As may be seen in FIG. 28, the seat 44' has a bottom surface 44*a'*, an upper surface, not indicated, two longitudinal end surfaces 44*b'*, 44*c'* and a lower surface. From FIGS. 29 and 30 it may be noted how the upper surface and the lower surface of the seat 44' are as a whole inclined in a direction transverse with respect to the development of the seat itself; the lower surface is shaped so as to define a prevalent portion 44*d'* and a portion 44*e'* defined hereinafter as "slide portion", at a slightly lower level with respect to the portion 44*d'* (from the comparison between FIGS. 30 and 31 it may be noted how the surface portion 44*e'* and the prevalent portion 44*d'* have very similar slopes, but lie on different planes).

Also in the embodiment in question a floating element 50 of a spheroidal shape is provided.

In the case of the variant in question, the dispenser 10 is fixed to a plane surface, or in any case it is fastened so as to assume a substantially horizontal position when the dishwasher door is open and a substantially vertical position when the dishwasher door is closed.

Figure 32:
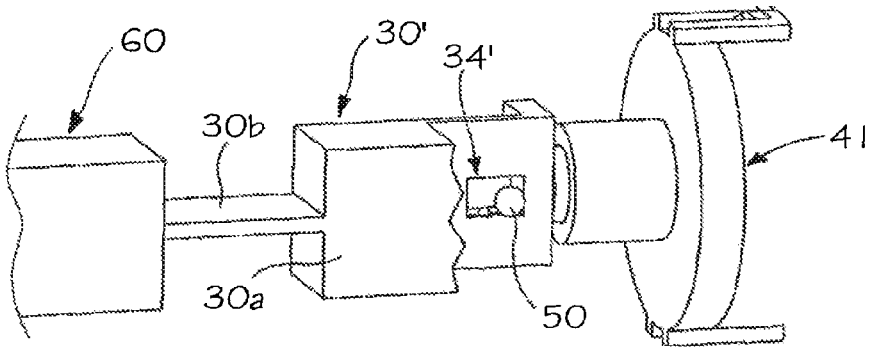
FIGS. 32 and 33 are a partially sectioned perspective view and a corresponding enlarged detail, respectively, of the actuation system of the dispenser of FIG. 23, in a first condition.
Figure 33:
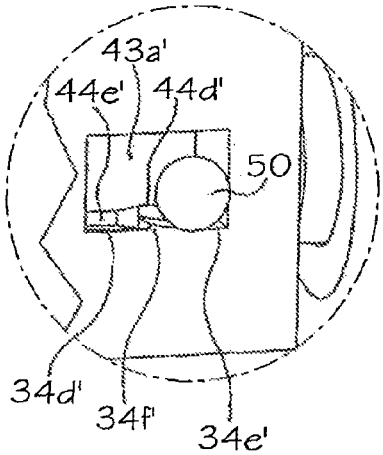

Visible in FIGS. 32 and 33 is the initial condition, at the start of a washing cycle, in which the ball 50 is located within the seat 34' of the lever 30', and in particular in the portion of lower surface 34*e'*. As may be appreciated also from FIG. 30, the ball 50 is prevented from displacing into the seat 44' since, in the condition in question, the portion of lower surface 44*d'* of the seat 44' is at a greater height than the portion of lower surface 34*e'* of the seat 34'; from FIG. 31 it may instead be noted how, in this position, the bottom end of the slide portion 44*e'* of the seat 44' is substantially at the same height as the portion of lower surface 34*d'* of the seat 34.

Figure 34:
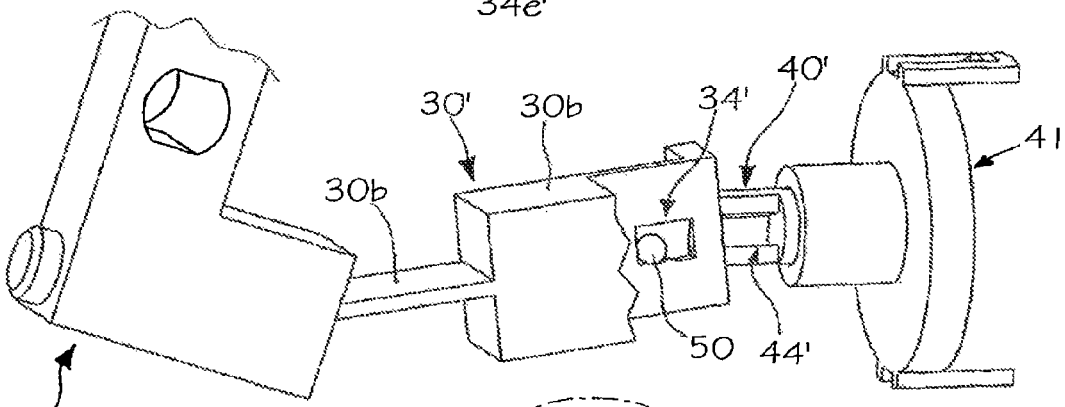
FIGS. 34 and 35 are, respectively, a view and a detail similar to those of FIGS. 32 and 33, with the actuation system of the dispenser in a second condition.

When the solid detergent has to be delivered, the programming device of the machine controls supply of the actuator 20' of FIG. 23, thus determining advance of the shaft 23', which in turn causes angular movement of the lever 60 as far as the position visible in FIG. 34. It should be noted that, on account of the characteristics proper to thermo-actuators, the movement of the shaft 23' is relatively slow, unlike the sharp movement of the core 23 proper to a solenoid actuator.

Figure 35:
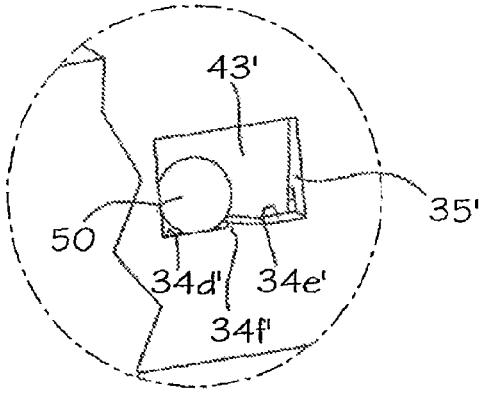

The movement of the lever 60 causes the rotation of the shaft 15, with the subsequent release of the lid of the dispenser 10; thanks to the articulated coupling existing between the lever 60 and the member 30' (see FIG. 24), the movement of the lever 60 causes both a pulling action on the member 30' and a certain angular movement thereof; the variation of the overall slope of the member 30' is such that the ball 50 will be able to pass beyond the cusp 34*f'* of the seat 34' and set itself in the portion of lower surface 34*d'*, as may be seen in FIG. 35. Also in this case, the pulling action exerted on the member 30' is not transferred in a significant way to the rod 40', since the relief 35' is free to slide within the seat 44'; At the end of the movement, the seat 34' also in this case faces a full region of the surface 43' of the rod 40' (see FIG. 35).

It should be noted that, during the first—relatively slow—cycle of actuation of the actuator 20', the ball 50 could reach a position corresponding to the slide portion 44*e'* even before it has passed beyond the cusp 34*f'*, with the apparent risk that the ball itself may pass, already in this step, onto the slide portion 44*e'*; in actual fact, however, in the course of the movement, the member 30' is inclined, dropping slightly with respect to the member 40' and thus determining a step between the two seats 34', 44' that is in itself sufficient to prevent the aforesaid risk. In any case the surface portion 34*d'* of the seat 34' could be inclined towards the bottom surface 34*a'*, as mentioned previously, should it be deemed necessary to eliminate also the aforesaid apparent risk.

Figure 36:
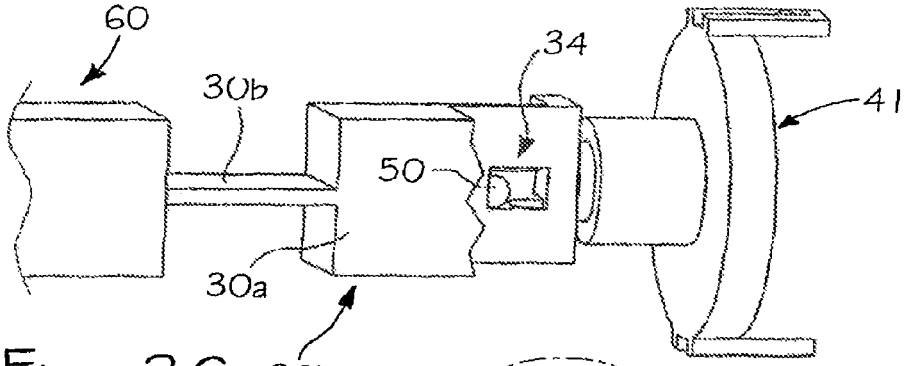
FIGS. 36 and 37 are, respectively, a view and a detail similar to those of FIGS. 32 and 33, with the actuation system of the dispenser in a third condition.
Figure 37:
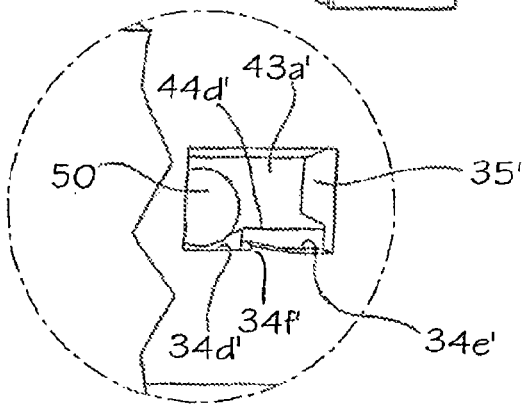

After interruption of the supply to the actuator 20', the shaft 23', the lever 60 and the member 30' return into their respective initial positions, as represented in FIGS. 36 and 37. In a way similar to the case of the first embodiment, the surface 33' of the member 30' slides with respect to the surface 43' of the rod 40', until the seats 34' and 44' again face one another.

In this position (see also FIG. 31 for reference) the lower end of the slide portion 44*e'* is substantially at the same height as the top of the portion of lower surface 34*d'*. In this way, given the inclined arrangement of the portion of lower surface 34*d'*, the ball 50 is free to roll on the slide portion 44*e'* of the seat 44, which is inclined in the same direction, until it comes into contact with the bottom surface 44*a'*. The ball 50 passes then from the seat 34' to the seat 44', remaining in the latter seat thanks to the inclination of the lower surface 44*d'*-44*e'* of the seat 44; it should be noted that, in effect, the ball 50 remains within the slide portion 44*e'*, given that the latter extends at a height lower with respect to the portion of lower surface 44*d'* of the seat 44.

Figure 38:
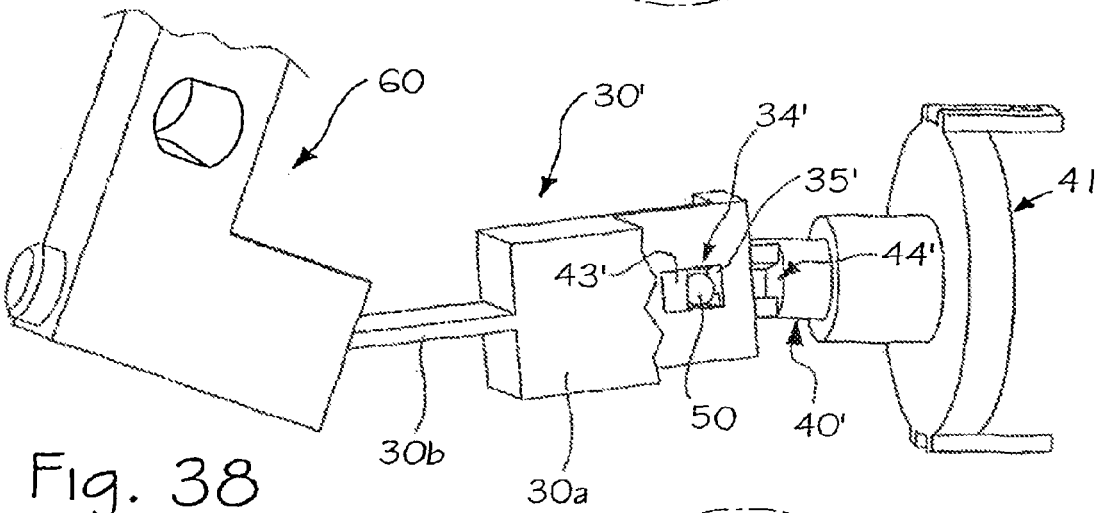
FIGS. 38 and 39 are, respectively, a view and a detail similar to those of FIGS. 32 and 33, with the actuation system of the dispenser in a fourth condition.
Figure 39:
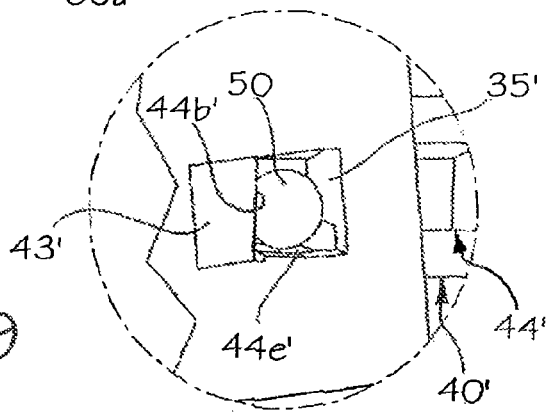

When, subsequently, delivery of a rinse aid dose is necessary, the programming device of the machine 1 brings about a new supply of the actuator 20', thus causing a new angular movement of the lever 60 and hence a new action of pulling/inclination of the member 30', as may be seen in FIGS. 38 and 39. During sliding of the member 30', the respective relief 35' can slide within the seat 44' of the rod 40', in which the ball 50 is now housed. As for the first embodiment, the stroke allowed for the relief 35' within the seat 44' is thus reduced so that, at a certain point—as illustrated in FIG. 38—the ball 50 will be set between the end surface 44*b'* of the seat 44' and the relief 35' of the moving member 30'. Part of the movement of the member 30' is then transferred to the rod 40', with the consequent linear translation of the latter, of a greater amount as compared to the first actuation. After interruption of the supply to the actuator 20', the piston 23', the lever 60, the member 30' and the rod 40' will return to the position of FIGS. 36 and 37.

It should be noted that, also in the case of repeated cycles of actuation of the member 30' and hence of the rod 40', the ball 50 remains normally set in a position corresponding to the slide portion 44*e'*, consequently not being subjected to any significant displacements within the seat 44'.

Also in this embodiment, resetting of the actuation system to the initial condition of FIGS. 32 and 33 is obtained after the end of the washing cycle, when the user opens the door of the machine, bringing it in a substantially horizontal position. When the door 10 has been turned over, the seat 44' of the rod 40' comes to occupy a position above the seat 34' of the member 30', with the ball 50 that can thus freely pass from the first seat to the second seat. In this case, given the inclined arrangement of the end wall 34*a'* of the seat 34' (see FIG. 29), the ball 50 is induced to roll until it comes into contact with the end surface 34*c'*. During subsequent closure of the door, the ball 50 will remain in the position reached, i.e., within the portion of lower surface 34*e'* (see, for example, FIG. 26), without being able to pass into the seat 44' (as has been said—see once again FIG. 30—the portion of lower surface 44*d'* of the seat 44' is at a greater height than the surface portion 34*e'* of the seat 34).

From the foregoing description there emerge clearly the characteristics and advantages of the present invention, which are principally represented by the compactness of the mechanism for coupling between the members of the actuation device, the simplicity of fabrication of its components, the substantial absence of mechanical wear between the interacting parts. A further advantage of the invention is represented is represented by the fact that the proposed actuation system allows for reducing the number of actuations required for obtaining a plurality of deliveries of the liquid washing agent, compared to the prior art.

It is clear that numerous variants are possible for the person skilled in the art of the dispenser described by way of example, without thereby departing from the scope of the invention as defined in the ensuing claims.

In accordance to a possible variant, the dispenser according to the invention is provided for being fixed to a sliding door of the washing machine, or to a surface of the washing chamber differing from the inner-door, or in a position such that it remains constantly vertical, or without variations of the plane of lie of the dispenser during passage of the door between the open and closed position. In said variant, in order to cause passage of the ball 50 from the seat 44 to the seat 34, at the end or before the start of a washing cycle, operatively associated to the dispenser is a magnetic element.

In a possible embodiment, said magnetic element comprises an electromagnet, which can be actuated selectively under the control of the programmer of the machine, in order to produce at the appropriate moment a magnetic field of suitable polarity to attract or else repel the ball 50 into the desired seat, respectively via a phenomenon of magnetic attraction or magnetic repulsion. The control system of the machine is, in this case, provided for generating the aforesaid magnetic field in the appropriate times and ways, and the ball 50, or the floating body of other form that performs the functions thereof, is made of a suitable material, preferably of a ferromagnetic type.

Another possibility is that of associating to the lid of the dispenser a permanent magnet, in a suitable position such that, with the lid closed, the magnetic field will affect the area of intersection between the members 30 and 40. The system can be conceived in such a way that the magnet will generate a force of attraction or repulsion such as to force the ball 50 into the seat 34; thus, following upon opening of the lid 72, with consequent moving away of the aforesaid magnetic field from the area of intersection between the members 30 and 40, the ball 50 will be able to pass from the seat 34 to the seat 44, in the ways described above; next, prior to starting of a new washing cycle, closing of the lid 72 will enable the magnetic field to be brought back into the area of interest, in order to cause passage of the ball 50 from the seat 44 to the seat 34, in order to reset the actuation system.

At least some of the elements described herein with reference to the various examples of embodiment of the invention may be present in a different number and arrangement; elements of different examples may possibly be combined together.

The invention claimed is:

1. A washing agent dispenser for a washing machine, having a first and a second washing agent distributor controlled by a same actuation system that comprises at least a driving member, a driven member and an actuator device which can be operated to cause a movement of the driving member, where a first one of said members has a first seat in which there is operatively inserted, with possibility of relative movement, an engagement part of a second one of said members, characterized in that the second one of said members has a second seat, which, in at least one position of the actuation system, at least partially faces the first seat of the first one of said members, and in that the actuation system further comprises at least one floating body, able to displace between the two seats when said seats at least partially face one another.

2. The dispenser according to claim 1, wherein the driving member and the driven member, or else the respective seats, are arranged or configured such that at least one displacement of the floating body from one seat to the other occurs in a selective or controlled way, namely:

as a function of the mutual position assumed by respective portions of the seats themselves following upon an actuation of the actuator means, and hence following upon a relative displacement between the driving member and the driven member; and/or following upon a variation of the angular position of the dispenser.

3. The dispenser according to claim 1, wherein the actuation system is arranged such that, following upon an actuation of the actuator device:

with the floating body in the first seat, the driven member performs a stroke having a first extent, or greater stroke, when the floating body is in the second seat, the driven member performs a stroke having a second extent, or smaller stroke, or else remains substantially motionless.

4. The dispenser according to claim 1, wherein the actuation system is arranged such that:

during an actuation of the system, with the floating body in the second seat, the engagement part can perform a maximum stroke within the first seat, in such a way as:

to cause a transfer by a first extent of the movement of the driving member to the driven member, or else to cause a non-significant transfer of the movement of the driving member to the driven member, or else not to cause a transfer of the movement of the driving member to the driven member; and during another actuation of the system, with the floating body in the first seat, the engagement part can perform only a reduced stroke within the first seat, in order to cause:

a transfer by a second extent of the movement of the driving member to the driven member, or else a significant transfer of the movement of the driving member to the driven member.

5. The dispenser according to claim 1, wherein the first and second seats are shaped as a slot of the respective member.

6. The dispenser according to claim 5, wherein the slot has dimensions such as to be able to house the floating body completely and allow at least one displacement thereof according to a longitudinal extension of the slot itself.

7. The dispenser according to claim 1, wherein the floating body has a substantially spheroidal shape.

8. The dispenser according to claim 1, wherein at least one of said members is able to perform angular movements.

9. The dispenser according to claim 1, wherein at least one of said members is able to perform linear movements.

10. The dispenser according to claim 5, wherein each member comprises a region having a surface in correspondence of which the respective seat opens.

11. The dispenser according to claim 10, wherein said surface of one member is arranged for co-operating in a sliding relationship with said surface of the other member.

12. The dispenser according to claim 1, wherein the engagement part has a lateral surface that is located in the proximity, or forms a prolongation, of a longitudinal end surface of the second seat.

13. The dispenser according to claim 5, wherein the second seat has a variable depth, or has an inclined bottom surface.

14. The dispenser according to claim 1, wherein the dispenser itself is designed to be installed on a door of a washing machine, said door being angularly movable between a substantially horizontal open position and a substantially vertical closed position, and the actuation system is arranged such that, with the floating body in the first seat, a passage of the door between the between the closed position and the open position causes passage by gravity of the floating body from the first seat to the second seat.

15. The dispenser according to claim 1, wherein the actuation system is arranged such that a passage of the floating body from the second seat to the first seat occurs by gravity, following upon a first actuation.

16. The dispenser according to claim 1, wherein means are provided for generating a magnetic field suitable for inducing, via magnetic attraction or repulsion, a displacement of the floating body.

17. The dispenser according to claim 1, wherein the driving member is operatively associated to the first washing agent distributor.

18. The dispenser according to claim 1, wherein the driven member is operatively associated to the second washing agent distributor.

19. The dispenser according to claim 1, wherein the driving member is connected to a transmission element of an actuation mechanism of a lid that is part of a detergent distributor and the driven member is connected to a valve device that is part of a liquid washing agent distributor.

20. The dispenser according to claim 1, wherein the driving member is articulated to an actuation element in such a way that a movement of the actuation element causes a roto-translational movement of the driving member.

21. A method for dispensing washing agents in a washing machine, by means of a dispenser having a first and a second washing agent distributor controlled by a same actuation system that comprises at least a driving member, a driven member and an actuator device which can be operated to cause a movement of the driving member, where a first one of said members has a first seat in which there is operatively inserted, with possibility of relative movement, an engagement part of a second one of said members, the method being characterized by the following operations:

providing the second one of said members with a second seat, which, in at least one position of the actuation system, at least partially faces the first seat of the first one of said members;

providing the actuation system with a floating body, capable of displacing between the two seats, when the two seats at least partially face one another;

selectively causing displacement of the floating body between the two seats, in such a way that, following upon an actuation of the actuator device:

with the floating body in the first seat, the driven member performs a stroke having a first extent, or greater stroke, and with the floating body in the second seat, the driven member performs a stroke having a second extent, or smaller stroke, or else remains substantially motionless.

* * * * *